US006277040B1

(12) United States Patent
Randolph

(10) Patent No.: US 6,277,040 B1
(45) Date of Patent: Aug. 21, 2001

(54) BALL BAT TAPER GRIP

(76) Inventor: James Todd Randolph, 31210 Kensington Park Dr., Spring, TX (US) 77386

( * ) Notice: Subject to any disclaimer, the term of this patent is extended or adjusted under 35 U.S.C. 154(b) by 0 days.

(21) Appl. No.: 09/490,363

(22) Filed: Jan. 24, 2000

(51) Int. Cl.[7] ..... A63B 59/06
(52) U.S. Cl. ..... 473/568; 473/457
(58) Field of Search ..... 473/564–568, 473/457

(56) References Cited

U.S. PATENT DOCUMENTS

| | | | | |
|---|---|---|---|---|
| 2,031,161 | * | 2/1936 | Hamel | 473/568 |
| 2,091,458 | * | 8/1937 | Sleight | 473/568 |
| 3,469,839 | * | 9/1969 | Pietronuto et al. | 473/457 |
| 4,940,247 | | 7/1990 | Magadini | 273/72 |
| 5,342,046 | | 8/1994 | Erb | 273/72 R |
| 5,577,722 | | 11/1996 | Glassberg | 273/26 B |
| 5,624,114 | * | 4/1997 | Kelsey | 473/564 |
| 5,839,983 | | 11/1998 | Kramer | 473/568 |

* cited by examiner

*Primary Examiner*—Mark S. Graham
(74) *Attorney, Agent, or Firm*—Mary J. Gaskin

(57) ABSTRACT

A resilient tapered grip for pulling over a ball bat handle to provide a gripping reference and to reduce bat sting. The grip is configured to provide a taper from the handle to the edge of the knob. Two devices can be used to provide a tapered gripping reference at a position higher on the handle.

9 Claims, 2 Drawing Sheets

BALL BAT TAPER GRIP

BACKGROUND OF THE INVENTION

This invention relates to a grip which cushions a ball bat holder's palm, heel of the hand, and fingertips. The grip also enables the ball bat holder to hang the lower portion of his hand off the knob of the ball bat. In multiples of two, the invention can be used as a "choke up" method.

A ball bat has a cylindrically-shaped barrel that tapers to a narrower handle section, to which is attached an enlarged disk-shaped knob, which acts as a resting point for the heel of the bat holder's lower hand as it grips the handle.

Forces created when a swung bat hits a ball can cause severe discomfort to the bat holder's palm, heel of the hand and fingertips. This "bat sting" is felt at the knob end of the bat, which generally is made of wood or aluminum. Bat holders have tried wrapping tape around the knob end (sometimes attempting to form a tapered configuration) to increase its "give" and thereby reduce discomfort. However, taping a bat, which requires patience and dexterity, is time-consuming and expensive; in addition, it must be redone on a regular basis. Further, taping a bat does not create a dependable, tapered grip for superior performance.

Numerous after-market devices have been developed to diminish "bat sting" and/or improve grip comfort. For example, U.S. Pat. No. 5,624,114 (Kelsey) discloses a shock-dampening sleeve which covers all or part of the knob. However, the product cushions only the heel of the hand and does not produce a tapered grip. An unpatented product by Easton® is comprised of a thin tube of flexible material (which may tear when pulled over the knob) which must be wrapped with lengths of synthetic grip material.

In addition, bat manufacturers themselves have fabricated bats with special handles to provide more comfortable gripping. Worth® makes a bat with a smaller-than-average knob for players who use the lower portion of the knob for a gripping reference or the "double-fisted" grip. Mizuno® used to make a bat with an enlarged knob having a tapered region from the knob to the handle. However, a ball player must purchase the whole bat to obtain the desired gripping reference.

A need exists for a tapered gripping reference which is easy to install on and remove from any standard ball bat.

SUMMARY OF THE INVENTION

The present invention provides comfort for the hand of a bat holder while gripping a ball bat. The "tapered" effect produced by the cylindrical, cone-shaped device acts as a cushion for the palm, heel of the hand, and fingertips of the ball bat holder. The invention is shaped to produce a taper from the knob to the handle. It can be used without any additional grip tape which bat holders ordinarily apply.

The taper grip enables the bat holder to position his lower hand farther down on the ball bat: the bat holder can hang the lower portion of his hand off the knob of the bat without experiencing pressure on his fingertips, heel of his hand, and palm caused when the ball bat is swung in the standard motion. Gripping a ball bat with part of the hand below the knob enables the bat holder to increase his bat speed, which increases the amount of energy transferred to the ball on contact with the bat. The present invention can also be used by batters who want to use a double-fisted grip.

The present invention can also be used as a "choke up" method when used in multiples of two, inverting the direction of the taper in the lowermost device and alternating the direction of the taper of the additional device(s).

Made from flexible material, the cone-shaped device has a cylindrical opening extending through its length to accommodate its being pulled over the bat knob and positioned tightly around the bat handle.

Using the device in multiples of two, alternating the direction of the taper, allows a ballplayer to have a tapered gripping reference while "choking up" on the bat.

The main object of the invention is to provide a firm, stable, cushioned, tapered grip for the ball player.

Another object of the invention is to provide a tapered grip which is easy to install and remove.

Yet another object of the invention is to provide a gripping reference at a lower point on the bat, permitting the player to hang one or more fingers off the knob without the associated blistering, pinching, or bruising of the hand and fingertips.

Still another object of the invention is to provide a "choke-up" reference on a ball bat, attained by alternating the direction of the taper of at least two of the devices, in multiples of two, with the narrow part of one of the devices at the lowermost part of the handle.

Another object of the invention is to provide a device which is usable on all types of ball bats, whether wooden or aluminum.

DESCRIPTION OF THE PREFERRED EMBODIMENT

Figure 1:
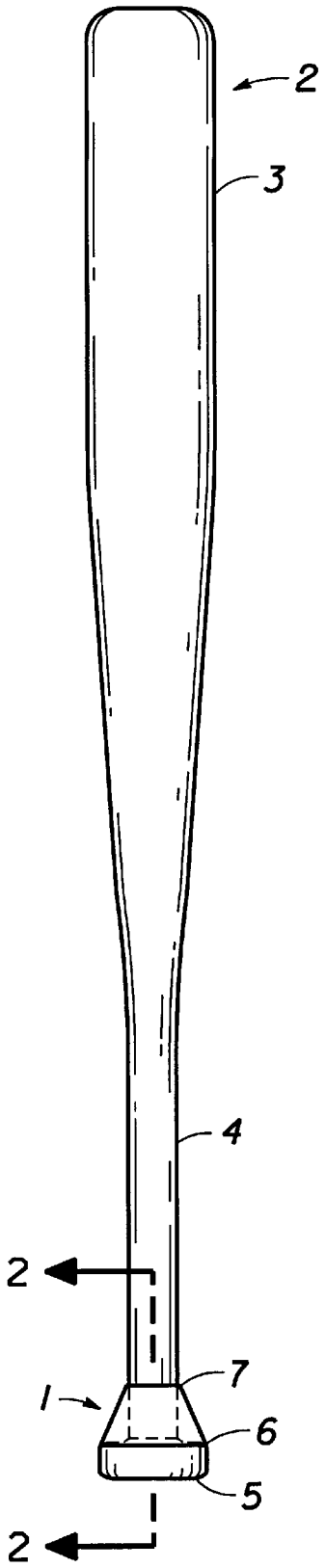
FIG. 1 is a side "see-through" view of the device disposed on the handle of a ball bat.

FIG. 1 shows a preferred embodiment of the taper grip 1 disposed on a ball bat 2. Used as a gripping reference, the taper grip 1 protects a batter's fingertips, palm, and the heel of his hand. The ball bat 2, made from wood, aluminum, or another rigid material, has a cylindrical barrel 3 for contacting a pitched softball or baseball, a cylindrical handle 4, and a disk-shaped knob 5. The taper grip 1 has been pulled over the knob 5 into position for use by a batter. Its lower outer edge 6 is flush against the outer edge of the top side of the knob 5. The upper inner edge 7 of the taper grip 1 rests flush against the handle 2. The taper grip 1, when formed from injection molding, can be made from elastomers such as "KRATON®", "VERSAFLEX™","DYNAFLEX®". The taper grip 1 can also be formed from compression molding or transfer molding, in which case it can be made from natural or synthetic rubber or a combination of both, such as a natural rubber/styrene butadiene rubber mixture, "31X" extruder rope rubber, or HD-30 cushion gum (both manufactured by BANDAG®). The choice of material used should give the taper grip 1 a desired shore A rating of between 30 and 65. Such a shore A rating means the taper grip 1 is resilient enough to stretch over the knob 5, yet still retain a close fit around both the handle 2 and across the top side of the knob 5.

Figure 2:
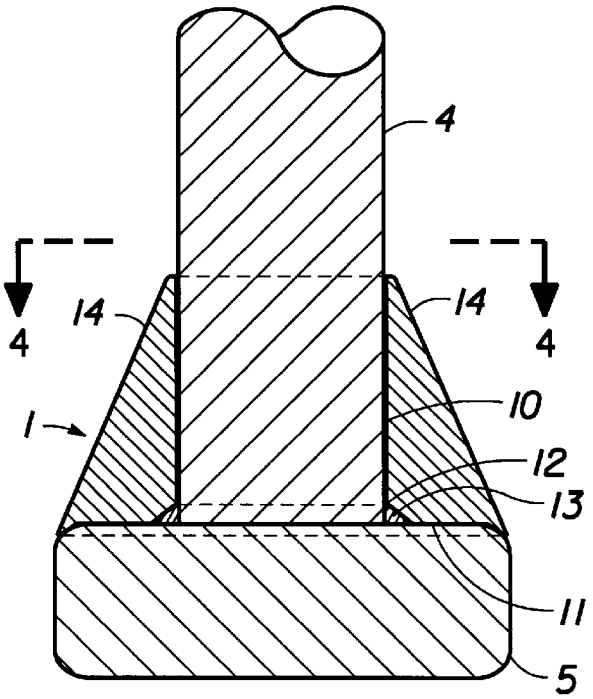
FIG. 2 is a partial cross-sectional view of the device disposed on the handle of the bat.

FIG. 2, a sectional view, shows the taper grip 1 more distinctly. The inner circumference 10 of the taper grip 1 rests flush against the handle 4, while the bottom side 11 of the taper grip 1 faces the knob 5. The lower inner edge 12 of the taper grip 1 has been beveled to accommodate any excess connecting material 13 (a result of welding or gluing the knob 5 to the handle 4). The taper grip 1 has been pulled into the position shown by stretching its inner circumference 10 over the knob 5 until the inner circumference 10 rest flush against the handle 4. The outer surface 14 of the taper grip 1creates a "taper" from the handle 4 to the knob 5, enabling the bat holder to use the taper grip 1 as a comfortable gripping reference to reduce the blistering, pinching and bruising often associated with batting.

Figure 3:
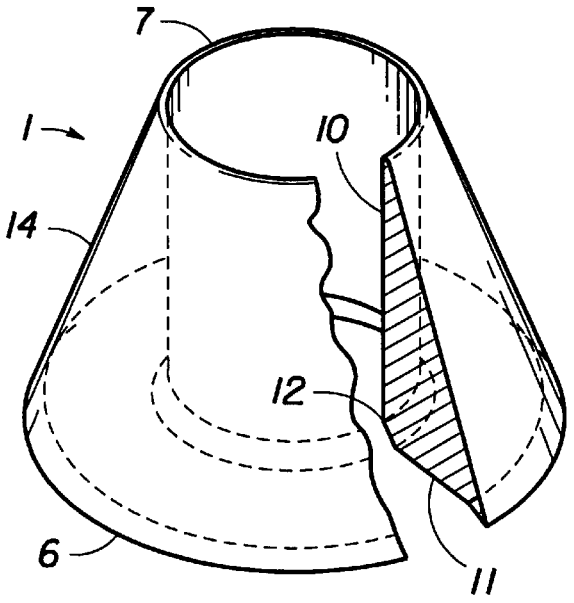
FIG. 3 is an isometric perspective view of the device, with a portion cut away.

FIG. 3 shows the shape of the taper grip 1 more clearly. FIG. 3 shows that the inner circumference 10 of the taper grip 1 is a cylinder, from its upper inner edge 7 to its lower inner edge 12. The bottom side 11 of the grip may be contoured to fit the surface of a particular type of knob. The outer tapered surface 14 of the taper grip 1 slopes from the smaller diameter of the upper inner edge 7 to the larger diameter of the lower outer edge 6 of the taper grip 1.

Figure 4:
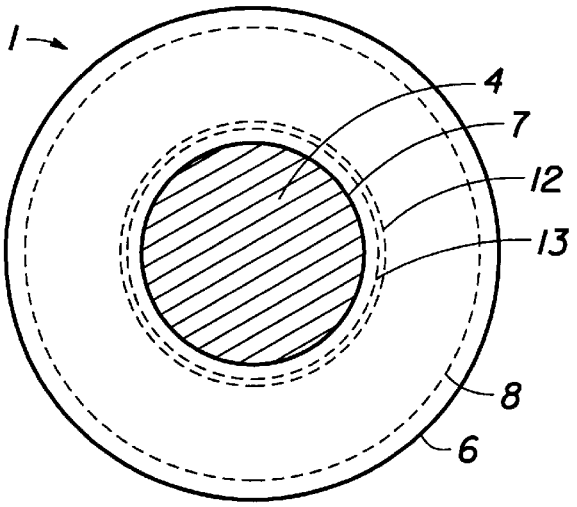
FIG. 4 is a top isometric sectional view taken through line 4—4 of FIG. 2.

In FIG. 4, the taper grip 1 is positioned on the handle 4. The upper inner edge 7 of the taper grip 1 is flush against the handle 4. The dotted circle closest to the handle represents the position of the excess connecting material 13; the adjacent dotted circle represents the lower inner edge 12 of the taper grip 1; and the outermost dotted circle represents the outermost edge 8 of the knob 5, which may be slightly overlapped by the lower outer edge 6 of the taper grip 1.

Figure 5:
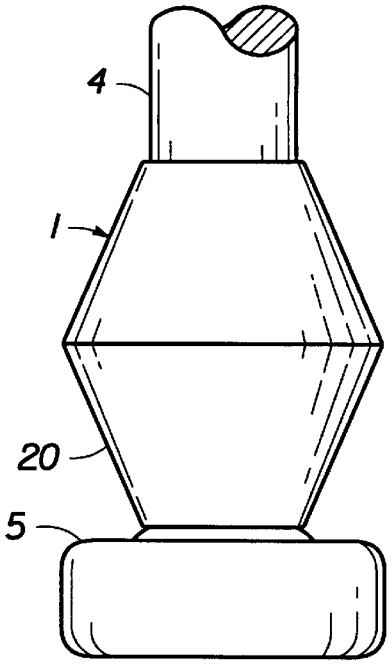
FIG. 5 is a side view of an alternate embodiment of the invention, with two of the devices disposed on the handle of the bat alternating the direction of the taper, in order to create a choke-up reference.

FIG. 5 shows the use of more than one taper grip in order to enable a batter to "choke up" on a bat. The first taper grip 1 has been pulled upwards on the handle 4, and then a second taper grip 20 has been turned upside down and pulled over the knob 5 until the larger diameter of both taper grips 1, 20 meet. The batter has a gripping reference at a higher position on the handle, while the "taper" is maintained. Additional taper grips can be added in multiples of two in order to create even higher gripping references.

Figure 6:
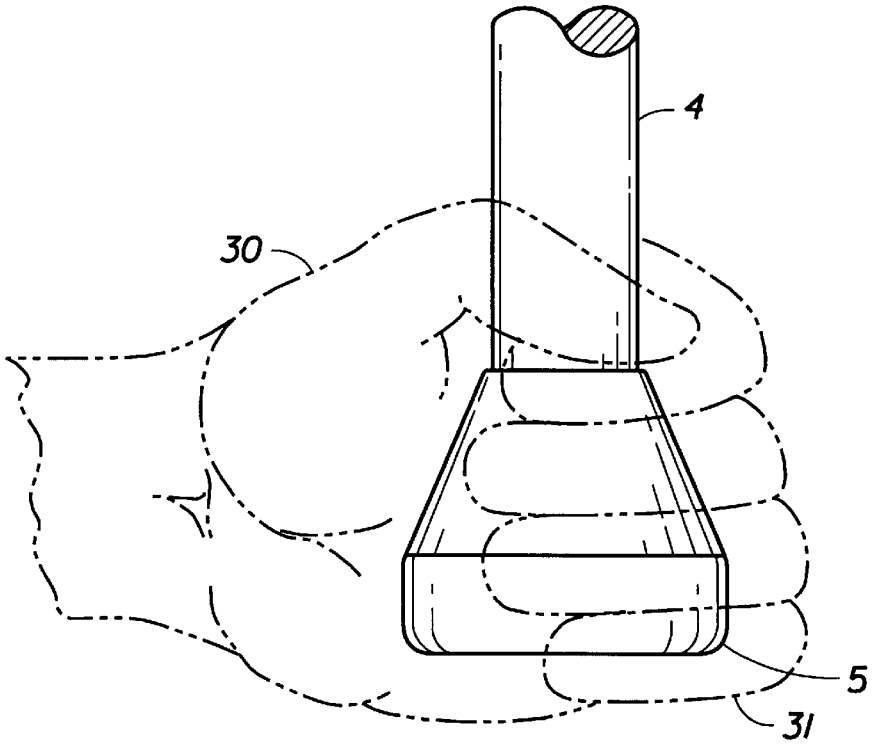
FIG. 6 is a side view of the device disposed on the handle of a bat, showing the position of the lower hand of a player who is using the device as a gripping reference to "hang" a finger off the knob of the bat.

In FIG. 6, a human hand 30 is shown gripping the taper grip 1, using it as a gripping reference. The fingers of the hand rest on the taper grip 1, without the obstruction of the knob 5. Similarly, the heel of the hand and the palm of the hand do not encounter an edge of the knob 5. Further, the bottomost finger 31 can comfortably "hang off" the knob 5.

The dimensions of the taper grip 1 can vary to some extent. The diameter of the inner circumference 10 of the taper grip 1 will generally be 1/16 of an inch smaller than the handle 4 of a standard ball bat. Therefore, ordinarily the diameter will be from 0.75 inches to 1 inch in measurement. The outer tapered surface 14 of the taper grip 1, which creates the "taper" (the smooth transition from the handle 4 to the knob 5), will form an angle of between 50 degrees and 80 degrees with the horizontal plane of the knob; the optimal angle for the "taper" is 70 degrees. The height of the taper grip 1, in other words, the distance from the upper inner edge 7 of the grip 1 to the lower inner edge 12 of the grip 1 (with an allowance for the optional bevel), can be from 1 inch to 2 inches. A height of 1.25 inches allows for the optimal grip for a standard ball bat. The lower inner edge 12 of the taper grip 1 may be beveled approximately 3/16 inches in order to allow the taper grip to rest on the top of the knob 5. In addition, the lower outer edge 6 of the grip may be curved downward slightly to allow it to fit flush to the slightly curving outermost edge 8 of the knob 5.

Persons skilled in the art to which this invention pertains may conceive of other embodiments of the invention, which may be drawn from this disclosure. The taper grip 1 can be used on other sports-related or nonsports-related instruments which include a handle for the user to grip when using. Some examples include the following: tennis, racquets, racquetball racquets, hockey sticks, golf clubs, broom handles, and hammer handles.

I claim:

1. A tapered grip for a ball bat, the ball bat having a handle with a handle diameter and terminating in a knob with a knob diameter and an upper surface, said handle having excess connecting material at its juncture with the upper surface of the knob, said taperered grip comprising:

a resilient generally conical body member disposed about a longitudinal axis and having an inside cylindrical passage with an upper end and a lower end, said cylindrical passage having a diameter approximately equal to the handle diameter, said lower end of the cylindrical passage being beveled to be adapted for accommodating the excess connecting material, said body member further having a lower outer end having a diameter substantially equal to the knob diameter, said body member further having an outer surface adapted to form a taper.

2. The tapered grip of claim 1 wherein the body member further has a bottom with a substantially flat surface for contacting the upper surface of the knob.

3. A The tapered grip of claim 1 wherein the body member comprises a material selected from the group consisting of natural rubber, synthetic rubber, or a combination of natural rubber and synthetic rubber.

4. The tapered grip of claim 1 wherein the body member comprises a material having a hardness between 30 and 65 on the Shore A scale.

5. The taper grip of claim 1 wherein the body member is sufficiently stretchable to slide over the knob and onto the handle and is sufficiently elastic to return the body member to its original shape.

6. A tapered gripping reference for a ball bat, the ball bat having a handle with a handle circumference and terminating in a knob having a knob circumference, said gripping reference comprising:

a first resilient generally conical body member disposed about a longitudinal axis and having an inside cylindrical passage sized in diameter such that said body member is adapted to fit movably snug around an external surface of the handle, said body member being essentially immovable when manually squeezed, said body member further having an exterior first end having an outer circumference slightly greater than the handle circumference and a second end having an outer circumference approximately equal to the knob circumference, said body member further having an outer surface forming a taper between the first end and the second end;

a second body member with the same dimensions as the first body member; said gripping reference being assembled by pulling the first body member upwards on the bat handle and inverting the second body member and pulling the second body member over the knob of the ball bat, and situating the second body member adjacent to the first body member.

7. The gripping reference of claim 6 wherein the body members comprise a material selected from the group consisting of natural rubber, synthetic rubber, or a combination of natural rubber and synthetic rubber.

8. The gripping reference of claim 6 wherein the body members comprise a material having a hardness between 30 and 65 on the Shore A scale.

9. The gripping reference of claim 6 wherein the body member is sufficiently stretchable to slide over the knob and onto the handle and is sufficiently elastic to return the body members to their original shape.

* * * * *